United States Patent [19]

Starostin et al.

[11] 4,169,365

[45] Oct. 2, 1979

[54] NEEDLE FOR PRESSING INTERNALLY-FINNED PIPES

[76] Inventors: Jury S. Starostin, ulitsa Pobedy, 69, kv. 47; Veniamin K. Erokhov, 13 Proezd, 19, kv. 14; Mikhail F. Golovinov, ulitsa Gvardeiskaya, 13, kv. 137; Antonina I. Berdjugina, prospekt Metallurgov, 90, kv. 30; Viktor I. Plokhov, ulitsa Stroitelei, 20, kv. 75; Lev. P. Kirillov, prospekt Metallurgov, 71-a, kv. 59, all of Kuibyshev; Anatoly A. Saprykin, ulitsa Sormovskaya, 10, korpus 1, kv. 38, Moscow; Vladimir N. Krotkov, ulitsa Chkalova, 24/32, kv. 132, Moscow; Anna N. Sergeeva, ulitsa Krivorozhskaya, 23, korpus 1, kv. 90, Moscow; Evgeny D. Konovalenko, 4 Prodolnaya ulitsa, 29, kv. 10, Melitopol Zaporozhskoi oblasti, all of U.S.S.R.

[21] Appl. No.: 761,987

[22] Filed: Jan. 24, 1977

Related U.S. Application Data

[63] Continuation of Ser. No. 756,704, Jan. 4, 1977, abandoned.

[51] Int. Cl.[2] ..... B21C 25/04; B21C 23/10

[52] U.S. Cl. ..... 72/264

[58] Field of Search ..... 72/264, 265, 469, 260; 425/467

[56] References Cited

U.S. PATENT DOCUMENTS

| | | | |
|---|---|---|---|
| 2,932,889 | 4/1960 | Kritscher | 72/342 |
| 3,808,860 | 5/1974 | Yamaguchi et al. | 72/264 |

FOREIGN PATENT DOCUMENTS

| | | | |
|---|---|---|---|
| 262760 | 1/1964 | Australia | 72/260 |
| 467168 | 8/1950 | Canada | 72/260 |
| 546827 | 10/1957 | Canada | 72/260 |
| 693999 | 9/1964 | Canada | 72/264 |
| 337478 | 5/1959 | Switzerland | 72/264 |
| 738762 | 10/1955 | United Kingdom | 72/260 |
| 1347703 | 2/1974 | United Kingdom | 72/264 |
| 129617 | 11/1957 | U.S.S.R. | 72/264 |
| 253734 | 2/1970 | U.S.S.R. | 72/269 |
| 237565 | 3/1970 | U.S.S.R. | 72/265 |
| 507379 | 7/1973 | U.S.S.R. | 72/264 |

*Primary Examiner*—Lowell A. Larson
*Assistant Examiner*—Daniel C. Crane
*Attorney, Agent, or Firm*—Fleit & Jacobson

[57] ABSTRACT

A needle comprising a cylindrical portion, a portion with longitudinal profiled channels intended to form the internal fins of a pipe, said portions being spaced apart lengthwise the needle and an intermediate portion joining the first two portions and varying in diameter which first decreases then increases in the direction from the cylindrical portion to the portion with profiled channels. The portion with profiled channels has the form of a truncated cone whose smaller base is directed towards the cylindrical portion. The needle according to the invention is used for pressing pipes with internal fins whose height exceeds their thickness by more than 4 times.

4 Claims, 7 Drawing Figures

NEEDLE FOR PRESSING INTERNALLY-FINNED PIPES

This is a continuation application of Serial No. 756,704, filed Jan 4, 1977 now abandoned. The present invention relates to plastic working of metals, more particularly, to needles for pressing internally-finned pipes.

The needle for pressing internally-finned pipes according to the present invention can be used with particular advantage for pressing pipes with comparatively high fins, i.e. the fins whose height is more than 4 times their thickness.

Known in the previous art are needles for pressing internally-finned pipes with two cylindrical portions spaced lengthwise apart, one of said portions constituting the body of the needle while the other one has longitudinal profiled channels intended to form the internal fins of the pipe. The walls of these channels are parallel to each other. Both of said portions are jointed by an intermediate portion in the form of two truncated cones facing each other by their smaller bases and a cylinder located between said cones. The larger bases of the truncated cones adjoin, respectively, the cylindrical body of the needle and the cylindrical portion with profiled channels.

The known needle is adapted for pressing internally-finned pipes wherein the ratio of the fin height to its thickness does not exceed four. Such pipes are utilized predominantly in heat exchangers.

Recently, a necessity appeared for intensifying the heat-exchange processes by increasing the surface washed by the heat carrier which, in turn, has required an increase in the height of the internal fins of pipes.

Accordingly, it has become necessary to manufacture pipes with comparatively high internal fins, i.e. the fins whose height would exceed their thickness more than four times.

An object of the present invention resides in providing a needle which would be suitable for manufacturing pipes with comparatively high internal fins.

In accordance with this object we hereby provide a needle for pressing internally-finned pipes comprising a cylindrical portion and a portion with longitudinal profiled channels intended to form the internal fins of the pipe, said portions being spaced apart lengthwise the needle and an intermediate portion joining the first two portions and varying in diameter, said diameter first decreasing then increasing in the direction from the cylindrical portion to the portion with profiled channels wherein, according to the invention, the portion with profiled channels has the form of a truncated cone whose smaller base is directed towards the cylindrical portion.

It is practicable that each profiled channel should have a cross section varying in length, increasing gradually towards the larger base of the truncated cone.

This shape of the channels permits their complete filling with metal in the course of pressing, improves the displacement of metal during pressing of fins and facilitates removal of the fins when the needle is freed from butt ends.

The needles for pressing internally-finned pipes according to the present invention provide for pressing pipes with internal fins whose height-thickness ratio exceeds four. Besides, these needles permit pressing of pipes with a practically unlimited thickness of their walls. Now the invention will be described in detail by way of example with reference to the accompanying drawings in which.

Figure 3:
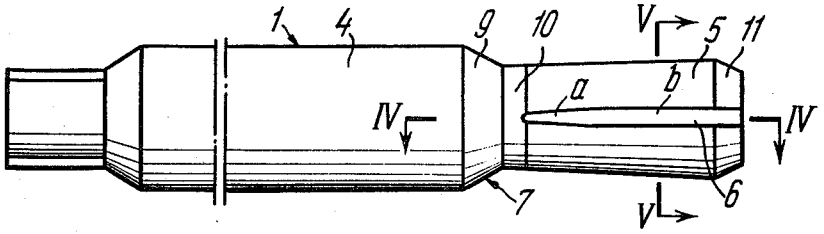
FIG. 3 is a general view of the needle for pressing internally-finned pipes according to the invention.

The needle 1 (FIG. 1) for pressing a pipe 2 (FIG. 2) with internal fins 3 consists of three portions: a cylindrical portion 4 (FIG. 3), a portion 5 with profiled channels 6 and an intermediate portion 7 joining the portions 4 and 5.

The cylindrical portion 4 is the longest one since it passes in a container 8 (FIG. 1) through a tubular billet A.

The intermediate portion 7 (FIG. 3) consists of two truncated cones 9 and 10; the smaller bases of said cones face each other while the larger base of the cone 9 faces the portion 4 and that of the cone 10 faces the portion 5.

The portion 5 has the form of a truncated cone whose smaller base is directed towards the cylindrical portion 4. The taper of the portion 5 is selected so as to ensure permissible tolerances on the wall thickness and diameter of the pipe being pressed. Depending on the required thicknesses and their tolerances the taper may vary from 0.003 to 0.5.

Figure 1:
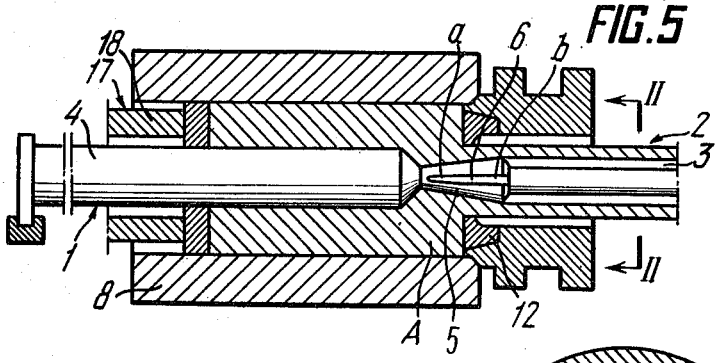
FIG. 1 shows a container and a die with the needle according to the invention, for pressing internally-finned pipes
Figure 2:
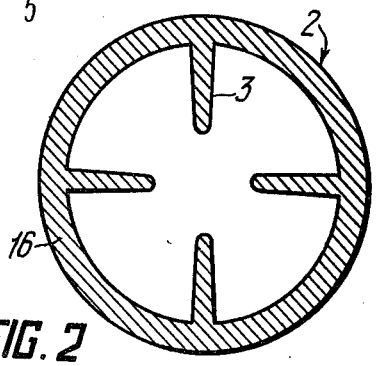
FIG. 2 is a section taken along line II—II in FIG. 1, enlarged, illustrating a cross section of a pipe with internal fins made by the needle according to the invention.

At the side of the larger base the portion 5 adjoins a truncated cone 11 intended to facilitate installation of the needle into the hole of a die 12 (FIG. 1).

The length of the portion 5 depends on the length of the profiled channels 6 and is equal to it. In the example described herein the channels 6 are equispaced around the circumference.

Figure 4:
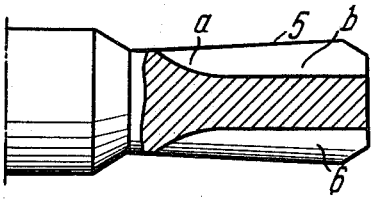
FIG. 4 is a section taken along line IV—IV in FIG. 3.
Figure 5:
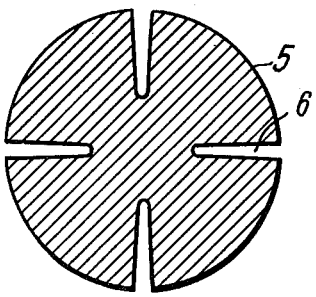
FIG. 5 is a section taken along line V—V in FIG. 3, enlarged.
Figure 7:
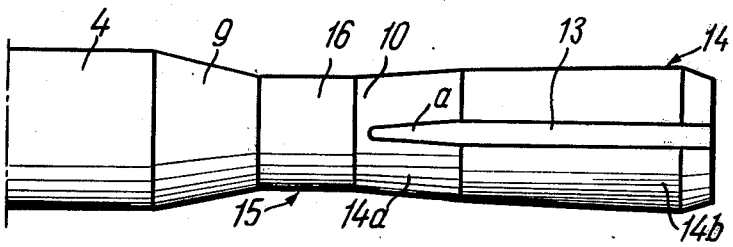
FIG. 7 shows the needle for pressing internally-finned pipes, another version.
Figure 6:
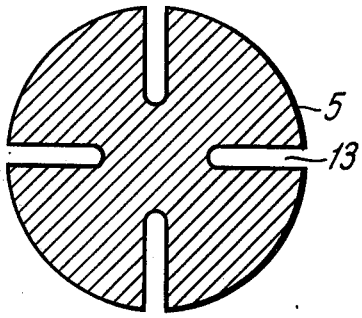
FIG. 6 is a section taken along line V—V in FIG. 3, enlarged, another version of channels.

The number of the channels and their arrangement around the circumference of the portion 5 corresponds to the required number of fins and to their arrangement in the pipe. The cross section of each channel 6 may taper off towards the geometrical axis of the needle (FIGS 4 and 5). In another possible version the channels 13 (FIGS. 6, 7) have parallel walls.

The channels 6 (FIGS. 4, 5) have a variable cross section gradually increasing towards the larger base of the truncated cone. This increase in the cross-sectional area is constituted both by the width and depth of the channel. The width and depth of the channel are increased due to the tapered surface of the portion 5. The part "a" (FIG. 4) of the channel 6 located nearer to the smaller base of the truncated cone of the portion 5 is made in such a manner that its cross-sectional area changes in length more intensively than that of the part "b." The length of the part "a" is approximately one quarter of the length of the channel 6.

The channels 13 (FIG. 7) with parallel walls are made on the portion 14 formed by two successively-arranged truncated cones **14*a* and 14*b*. The taper of the truncated cone 14*a* is considerably larger than that of the truncated cone 14***b*. The part "a" of the channel 13 is located on the cone 14*a*.

The intermediate portion 15 joining the portions 4 and 14 is formed by two truncated cones 9 and 10 whose smaller bases face each other and by a cylindrical body 16 located between said two cones.

This shape of the needle ensures complete filling of deep and narrow profiled channels.

Other shapes of the intermediate portion are also possible provided its diameter varies in length, first decreasing then increasing. This construction of the intermediate portions ensures the accumulation of metal required for filling the channel during fin pressing and facilitates freeing of the channels from butt ends on completion of the pressing operation.

Pressing of internally-finned pipes with the aid of the needle according to the invention is performed as follows.

A tubular billet "A" with a cylindrical axial hole inside is placed into the container 8. Then the needle 1 is passed through said cylindrical hole and the profiled portion 5 of the needle is set in the hole of the die 12 and fixed immovably therein.

While the needle 1 is being passed through the hole in the billet "A" and set in the hole of the die 12, the cone 11 acts as a guide to facilitate this setting.

The needle is set in such a position that the parts "b" of the profiled channels 6 are in the hole of the die 12 while the parts "a" of the profiled channels 6 are inside the billet "A".

After installation of the needle, the part "b" of the profiled portion 5 should protrude beyond the die 12 in the direction of pressing.

The taper of the portion 5 facilitates its setting in the hole of the die 12 since it allows this portion to be made longer, viz., from 10 to 100 mm and over.

Then the billet "A" is pressed by a plunger 17 through a dummy block 18 thus pressing the pipe 2 into the gap formed by the hole of the die 12 and the contour of the profiled portion 5 installed in the die 12.

Pressing continues until the larger part of the volume of the billet "A" is pressed out in the form of a pipe. Then the butt ends are left in the container 8, said butt ends being equal to 8–20% of the initial billet volume, approximately. In the foremost position in the direction of pressing the dummy block 18 should not move beyond the larger base of the truncated cone 9.

Then the butt ends are severed by one of the known methods. According to one of these methods without stopping the pressing work, the needle 1 is shifted forward in the direction of pressing at a speed approximately equal to the speed of the dummy block 18 and the smallest diameter of the intermediate portion 7 is set in the hole of the die 12. The needle is fixed in this position and the metal continues to be pressed from the volume of the butt ends. Inasmuch as the portion 6 with profiled channels is brought outside the hole in the die 12, pressing of the metal of the billet "A" does not fill the profiled channels 6. At the same time the metal filling the zone adjoining the intermediate portion 7 is expanded in the zone of the truncated cone 10, thus freeing the portion with profiled channels.

Then the needle 1 is shifted freely back against the direction of pressing and the portion 5 with profiled channels 6 is inserted into the press plunger 17. Then the container 8 is moved off and the butt ends are cut away.

According to the second method, after leaving the butt ends, the pressure on the plunger 17 is relieved and said plunger 17 is moved back against the direction of pressing. Now the needle is pulled out of the butt ends in the same direction.

Depending on the dimensions of the pipes being pressed, it is possible to use other methods of removing the butt ends.

While pressing internally-finned pipes with the aid of a needle with profiled channels it is necessary to satisfy the following conditions: fill the profiled channels 6 full with metal thus forming the fins, move the formed fins along the channels in the direction of pressing beyond the plastic zone of the die and see that the fins 3 of the pipe 2 do not break off from its wall and, finally, remove completely the fins 3 of the pipe 2 from the profiled channels before severing the butt end.

In the above described design of the needle 1 occupying the above-mentioned position relative to the die 12, the metal of the billet "A" fills completely the narrow profiled channels 6, in the course of pressing thus forming thin and high fins 3 of the pipe 2.

These channels are filled with the metal being pressed due to the flow of metal simultaneously in the radial direction from the periphery to the axis of the portion 5 and in the axial direction, along the channels 6 of the portion 5. In view of the fact that the portion 5 has the shape of a truncated cone whose smaller base faces the cylindrical portion 4 of the needle 1, the component of the pressing force directed towards the pressing axis is considerably stronger than in the case of a cylindrical portion with profiled channels which facilitates filling of the channels 6 with metal. Expansion of the channels 6 in the direction from the smaller base of the truncated cone of the portion 5 to the larger base facilitates the flow of metal forming the fins 3 along the profiled channels 6 and prevents the possibility of the internal fins 3 breaking off the internal surface of the wall of the pipe 2. This makes it possible to press with any practically reasonable thickness of their walls, i.e. from 1.5 mm to 50 mm.

This happens because the expansion of the channels 6 reduces the effect of the forces of friction on the moving formed fins 3. Having left the hole in the die 12, the fins 3 retain the dimensions they had in the hole of the die 12. In addition, beyond the hole in the die 12 the profiled channels 6 also expand and do not, therefore, interfere with the movement of the fins 3.

The movement of the fins 3 is also facilitated by the taper of the portion 5 because the pipe 2 leaving the hole in the die 12 continues moving along the tapered portion 5 and is expanded there increasing in diameter, which aids in pulling the fins out of the needle slots.

The taper of the portion 5 with profiled channels 6 makes it possible to free the channels 6 before separating the butt ends irrespective of the method of their separation. When the butt ends are separated by the first of the abovedescribed methods, expansion of metal from the zone ajoining the intermediate portion 7 does not result in filling of the channels 6 since the pressure of metal is insufficient for this purpose.

In the other method of separation of butt ends, described above, the pressure of metal during withdrawal of the needle is likewise insufficient for filling the channels 6.

The above-described types of needles realized in accordance with the present invention have passed experimental tests and ensured the manufacture of pipes with various diameters, wall thicknesses and fin heights. Among the pressed pipes were those with a minimum diameter of 30 mm, a wall thickness from 1.5 to 3 mm, with fins 1.5 and 2 mm thick and 6 and 9 mm high, and pipes with a maximum diameter of 200 mm, a wall thickness of 7 and 50 mm, an average thickness of the fins of 6 and 4 mm and with the height of the fins varying from 25 to 40 mm. Besides, there were pressed pipes of intermediate diameters with the corresponding ratios of fins heights and thicknesses.

The pressed pipes proved to be of a high quality required for their use in heat exchangers.

We claim:

1. A needle having a longitudinal axis for pressing internally-finned pipes comprising a cylindrical portion; a pair of truncated cones having conjoint bases, said truncated cones and conjoint bases having surfaces nonparallel with the longitudinal axis of the needle, one of said pair forming a portion with longitudinal profiled channels intended to form the internal fins of said pipe; and intermediate portion joining said cylindrical portion and the portion with profiled channels and varying in diameter which first decreases then increases in the direction from said cylindrical portion to the portion with profiled channels; said portion with profiled channels having a smaller base directed towards said cylindrical portion and a larger base conjoint with the larger base of the other of said pair of truncated cones.

2. A needle according to claim 1 wherein each profiled channel has a variable cross section in length, gradually increasing towards the larger base of the truncated cone.

3. A needle according to claim 2 wherein each profiled channel in the vicinity of the larger base of the truncated cone has a length in an axial direction of the cone at least four times the width of the profiled channel at the circumference of the truncated cone.

4. A needle according to claim 1 wherein a cross section of said longitudinal profiled channels is generally V-shaped.

* * * * *